US008397942B2

(12) United States Patent
Bartol

(10) Patent No.: US 8,397,942 B2
(45) Date of Patent: Mar. 19, 2013

(54) STORAGE CONTAINER

(76) Inventor: Sheila Bartol, Lewisburg, PA (US)

( * ) Notice: Subject to any disclaimer, the term of this patent is extended or adjusted under 35 U.S.C. 154(b) by 1066 days.

(21) Appl. No.: 12/199,700

(22) Filed: Aug. 27, 2008

(65) Prior Publication Data

US 2009/0101664 A1 Apr. 23, 2009

Related U.S. Application Data

(60) Provisional application No. 60/999,419, filed on Oct. 18, 2007.

(51) Int. Cl.
*B65D 6/40* (2006.01)

(52) U.S. Cl. ..... 220/745; 220/495.06; 383/97; 383/98

(58) Field of Classification Search ..... 220/495.06, 220/745; 383/97, 98
See application file for complete search history.

(56) References Cited

U.S. PATENT DOCUMENTS

| | | | | |
|---|---|---|---|---|
| 6,422,278 | B1 * | 7/2002 | Grogan | 150/105 |
| 7,320,411 | B1 * | 1/2008 | Shenosky et al. | 220/495.06 |
| 2002/0092213 | A1 * | 7/2002 | Chin | 40/6 |
| 2003/0029534 | A1 * | 2/2003 | Ma | 150/113 |

* cited by examiner

*Primary Examiner* — Anthony Stashick
*Assistant Examiner* — Elizabeth Volz
(74) *Attorney, Agent, or Firm* — Charles L. Riddle, Esq.; Riddle Patent Law, LLC

(57) ABSTRACT

An improved flexible storage container [1000] is sized and shaped to hold and store a specific item, such as a handbag. It employs a front wall [1100], a rear wall [1130], and side walls [1150] which are made of a breathable material. Moisture is allowed to pass in or out of the container to keep moisture equilibrium. Pockets [1113, 1153] inside of the walls [1100, 1130] may be used to hold front and side supports [1115, 1155] to make the storage container [1000] more rigid. A hypoallergenic barrier [1200] which acts as a liner inside of container [1000] employs material having a tight weave with pores 10 microns or smaller to keep out dust, dust mites or other allergenic materials. The storage container [1000] is capable of storing items for long periods of time with little or no change to the item. It also minimizes allergic reactions to those using the items after storage.

9 Claims, 7 Drawing Sheets

STORAGE CONTAINER

CROSS REFERENCE TO RELATED APPLICATIONS

This application is a Continuation-In-Part of U.S. Provisional Patent Application Ser. No. 60/999,419 "Improved Storage Container" filed Oct. 18, 2007 by the same inventor as the present application, Sheila Bartol. The present application claims priority from this application as if it were set forth in its entirety herein.

FEDERAL SPONSORED RESEARCH

Not Applicable

SEQUENCE LISTING OR PROGRAM

Not Applicable

BACKGROUND OF THE INVENTION

1. Field of the Invention

The invention generally relates to a storage container for storing and protecting the stored items.

2. Discussion of Related Prior Art

Handbags and other items may be stored for long periods of time. If the stored items are made of certain material which may be destroyed by the elements, such as leather, fur and suede, they are more difficult to store without being damaged.

Many of these items are destroyed when moist for a long period of time. These items become discolored, malformed and develop mold and fungus which eat away at the item.

On the other hand, if the items are stored with very little or no moisture, they become dry and develop cracks.

Previous containers were sized to be general catch-all storage containers that held numerous objects. These were not specifically designed to store specific items and were many times too large. This allowed several items to be piled and stored together, causing folding and creasing.

Other items were too small to receive support from the container and tended to fall and remain in that position as long as they were stored. These items develop permanent creases over time.

Enclosed items, such as handbags, tend to accumulate dust and dust mites which feed on the dust. The dust embeds into the items making them dirty, and the dust mites infested the stored item. These typically cause allergic reactions to those using the items after storage.

Stored items fade, dry and crack when exposed to light. Therefore, transparent containers also are not optimum for storage.

Once the items are discolored, cracked, moldy, or deformed, they are almost impossible to restore to their original conditions.

Since the best containers are not transparent, it is difficult to know what is inside the storage containers without opening them. Therefore, a more direct method of identification is required.

Currently, there is a need for a storage container which does not lock in moisture but allows some moisture in, is fitted to its intended use, blocks sunlight, is hypoallergenic and easily identifies its contents.

SUMMARY OF THE INVENTION

The present invention may be embodied as an improved flexible storage container [1000] for storing an item comprising:

a) at least one wall [1100, 1130, 1150] made of a breathable material which allows passage of moisture through it in either direction, sized and shaped to hold the item in an upright unfolded position;

b) an inner hypoallergenic barrier [1200] constructed of a material having pores of less than 10 microns for preventing dust from entering the storage container [1000], the barrier having a closable opening;

c) a closure device on the closable opening which has no openings greater than 10 microns when closed.

The present invention may also be embodied as an improved flexible storage container [1000] for storing an item comprising:

a) at least one wall [1100, 1130, 1150] made of a breathable material which allows passage of moisture through it in either direction, sized and shaped to hold the item in an upright unfolded position;

b) an inner hypoallergenic barrier [1200] constructed of a material having pores of less than 10 microns for preventing dust from entering the storage container [1000], the barrier having a closable opening;

c) a closure device on the closable opening which has no openings greater than 10 microns when closed.

Objects of the Invention

It is an object of the present invention to provide an improved flexible storage container which is hypoallergenic.

It is another object of the present invention to provide an improved flexible storage container which stores products and allows excess moisture to dissipate.

It is another object of the present invention to provide an improved flexible storage container which stores products and allows an optimum amount of moisture to be retained.

It is another object of the present invention to provide an improved flexible storage container which is sized to the size of the item to hold the item in an upright position.

It is another object of the present invention to provide an improved flexible storage container which is sized to hold handbags in an unfolded position.

It is another object of the present invention to provide an improved flexible storage container which is hypoallergenic.

It is another object of the present invention to provide an improved flexible storage container which is opaque.

It is another object of the present invention to provide an improved flexible storage container which provides an indication of its contents on the outside.

BRIEF DESCRIPTION OF THE DRAWINGS

The nature and further advantages of the invention will become more apparent upon consideration of the illustrative embodiment of the invention which is schematically set forth in the drawings, in which.

DETAILED DESCRIPTION OF THE DRAWINGS

Figure 1:
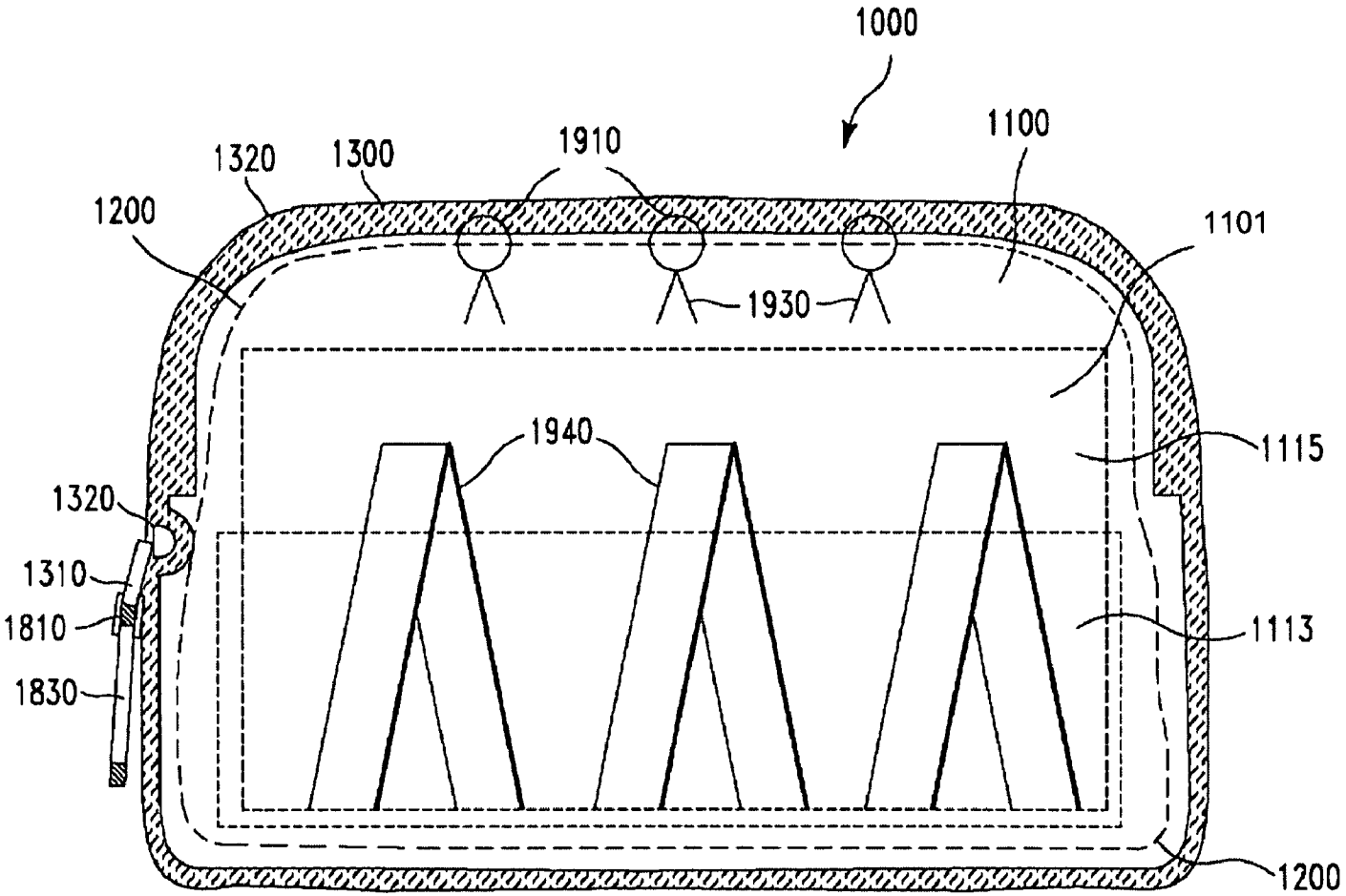
FIG. 1 is a front elevational view of one embodiment of the improved flexible storage container of the present invention.

While the invention is open to various modifications and alternative forms, specific embodiments thereof are shown by way of examples in the drawings and are described herein in detail. There is no intent to limit the invention to the particular forms disclosed.

Overview

The present invention is an improved flexible storage container for storing items which typically are difficult to store, for example, leather products such as shoes or handbags. Many of the upscale handbags can cost up to tens of thousands of dollars. These are typically made of leather. The improved handbag is made from a material which is allowed to 'breathe' and dissipate excess moisture. This eliminates mold.

It also retains a small amount of moisture to insure that the stored item does not dry and crack.

The size and shape holds handbags in an upright position alleviating permanent folds and creasing. It may also include clips or hangers to hold the stored item in an upright position.

There is also a hypoallergenic barrier which minimizes the introduction of dust, dust mites and similar organisms.

Also, the improved storage container includes an identification (ID) tag showing a picture, drawing, image or description of the contents without the need to open the container.

Dust collects in prior art storage containers. Since dust is one of the major contributors to allergenic reactions, such as asthma and common respiratory allergies, it is beneficial to limit or prevent dust from accumulating in stored items which come in close contact with users.

Dust, by its nature includes a large amount of organic material. Dust mites are attracted to the organic material and feed upon it. After pollen, dust mites and dust mite feces are the second most common sources of allergies.

Dust mites are approximately 250-300 micrometers ($10^{-6}$ meters) in size. Dust mite feces are approximately 50 nanometers ($10^{-9}$ meters) in diameter. Therefore, it is important that the present invention provides a hypoallergenic barrier which will stop the collection of dust mites and their feces.

Hypoallergenic also refers to the type of materials used. Some fabrics break off small fibers which become airborne. These airborne fibers are breathed in by people who develop allergies to the fabric.

Therefore, hypoallergenic should refer to prevention of the collection of dust, dust mites, dust mite feces and airborne fabric fibers, among other allergens.

The preferred fabric used is a blend of cotton and polyester, in a 45/55 mixture. Other fabrics could be silk and all cotton.

FIG. 1 is a front elevational view of one embodiment of the improved flexible storage container of the present invention.

Storage container has an internal cavity 1101 sized and shaped to hold and store an item in an upright, unfolded position without allowing it to flop over. In this example, storage container 1000 is sized and shaped to hold and store a handbag.

A front wall 1100 of storage container 1000 is shown. Front wall 1100 may be made of a tight-weave breathable and flexible material. It may employ a front pocket 1113 for inserting a rigid front support 1115 for making the front wall 1100 rigid.

This material is preferably all cotton or a cotton, polyester blend material. In a preferred embodiment, it is constructed of 8.5 oz heavy cotton material. These may also be made in numerous colors allowing for color coding of its contents.

The walls of the storage container 1000 and rigid supports all must be made of a breathable material such as cotton. This allows moisture to equalize through the walls.

The breathable material allows excess moisture to exit the storage container 1000 and enter the atmosphere.

When there is little or no moisture in the storage container 1000, the breathable material allows moisture to enter the storage container 1000 from the local atmosphere.

Due to its nature, it is partially opaque, stopping the majority of light which would cause long-term damage to leather material, but passes enough light to stop the development of mold.

In reality, barrier 1200 lines the inside of storage container 1000 and is attached to the inside of storage container 1000. It provides a continuous barrier throughout the inside of storage container 1000. The edges 1210 of barrier 1200 attach to the closure device 1300, which is a zipper 1320 in this embodiment. Closure device 1300 is specially made to have mechanical parts which do not have gaps greater than 10 micrometers.

If the closure device 1300 is a zipper 1320, the material of the zipper 1320 must be made of a tight weave material which also has pores of less than 10 micrometers to prevent collection of unwanted allergenic materials.

Hypoallergenic barrier 1200 is constructed of a tight weave material having pore sizes less than 10 microns in diameter.

The hypoallergenic barrier 1200 material is preferably a tight-weave cotton having microscopic openings between the fibers of no greater than 10 microns. This can be known hypoallergenic materials which line the storage container 1000.

The construction is intended to keep out dust particles which are typically on the order of 50 microns in size, and dust mites which are on the order of 200 microns in size. The absence of dust and dust mites is preferable for those having allergic reactions.

One material which may be used is Allergen-Barrier Bedding, Style 57180, PRISTINE® 45/55 Poly/Cotton blend, manufactured and distributed by Pristine Fabrics Group, Inc. 201 North Elm Street, Greensboro, N.C. 27401. This exhibits pore size of 7.7 micrometers, small enough to be a barrier against dust mites and dust mite feces.

Since this storage container is designed to be hypoallergenic, any seams of the hypoallergenic barrier 1200 must be sealed having openings less than 10 microns in size. If seams are to be stitched, they must be folded, then double stitched or joined by equivalent attachment means to have less than 10 micron openings.

A zipper pull 1310 is used to open and close a zipper 1320 on the improved storage container 1000.

Since the storage container 1000 is opaque to prevent sunlight from damaging its contents, there is an ID tag 1810 attached to it by a tag clip 1830. As stated above, ID tag preferably shows a picture, drawing, image and/or description of the contents of flexible storage container 1000. ID tag 1810 may also be made in the shape of a handbag for the handbag storage embodiment.

Alternatively, it may include color-coding to identify specific types of items.

The purpose of the ID tag 1810 is to quickly identify the contents of container 1000 without the need to pull it off of the shelves or open the container 1000.

Figure 2:
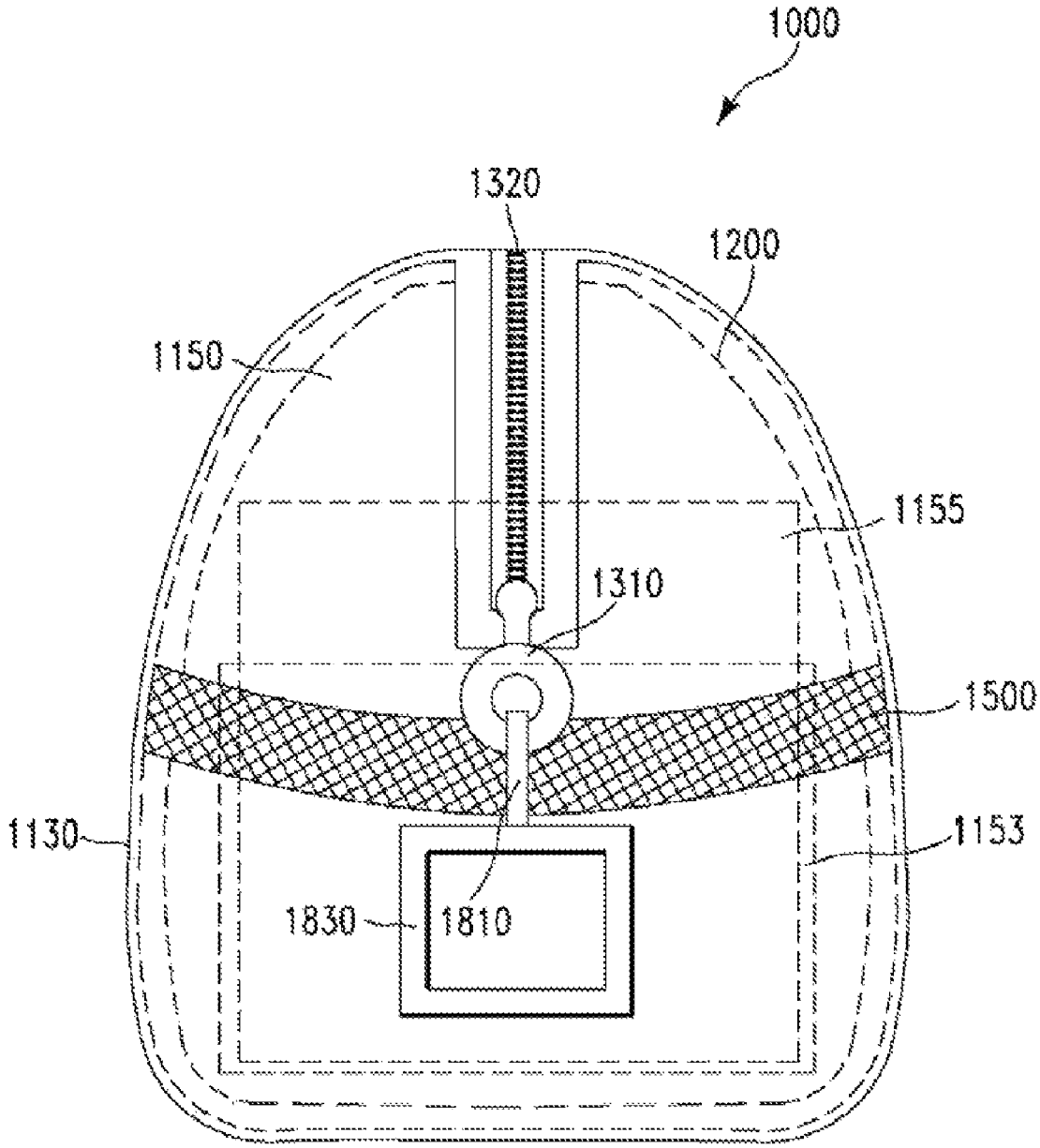
FIG. 2 is a side elevational view of the improved flexible storage container of FIG. 1 in a closed position.

FIG. 2 is a side elevational view of the improved storage container of FIG. 1 in a closed position. Here a side wall 1150 is shown. Side wall 1150 may be made of a flexible material or a rigid material. It may also include a side support 1155 which fits into side pocket 1153.

The hypoallergenic barrier 1200 and rear wall 1130 are also visible as well as the zipper 1320, zipper pull 1310, ID tag 1810 and tag clip 1830.

Figure 3:
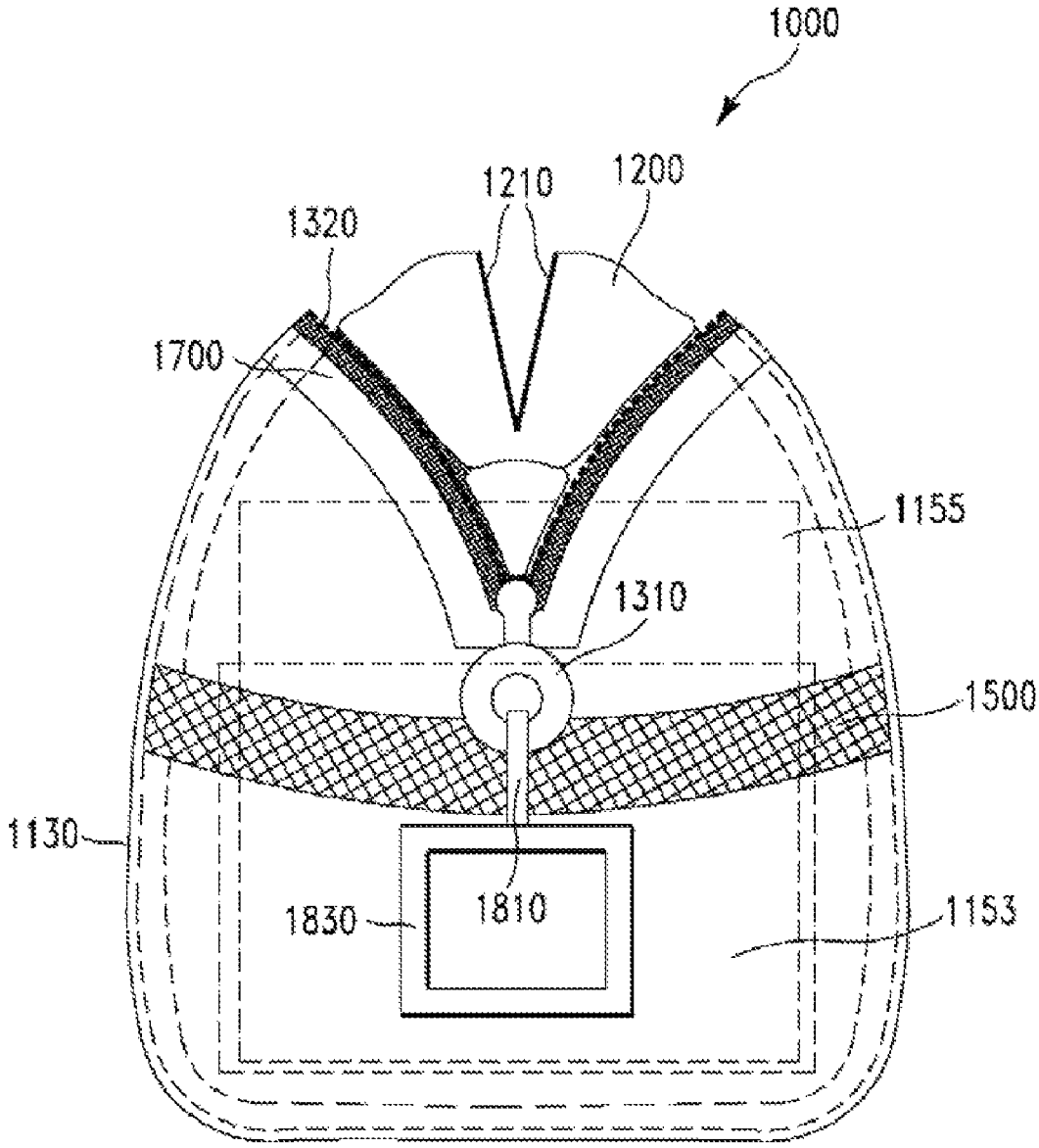
FIG. 3 is a side elevational view of the improved flexible storage container of FIG. 1 in an open position.

FIG. 3 is a side elevational view of the improved storage container 1000 of FIGS. 1 and 2 with zipper 1320 in its open position and the barrier 1200 detached and exposed to illustrate it.

Zipper pull 1310 can also be seen here. This is used to open and close zipper 1320. Zipper 1320 is preferably also constructed of a tight weave material minimizing the entry of dust and dust mites.

Storage container 1000 may also include an expandable gusset 1700 near its opening.

It can be seen here that the shape allows several of these storage containers 1000 to be packed side-by-side in a compact nature.

ID tag 1830 identifies the contents of storage bag 1000. Tag clip 1810 which holds ID tag 1830 to zipper pull 1310 are also shown here.

As shown in FIG. 2, it may also include a side support 1155 which fits into side pocket 1153

Optionally, there may be a handle 1500 for carrying the storage container.

Figure 4:
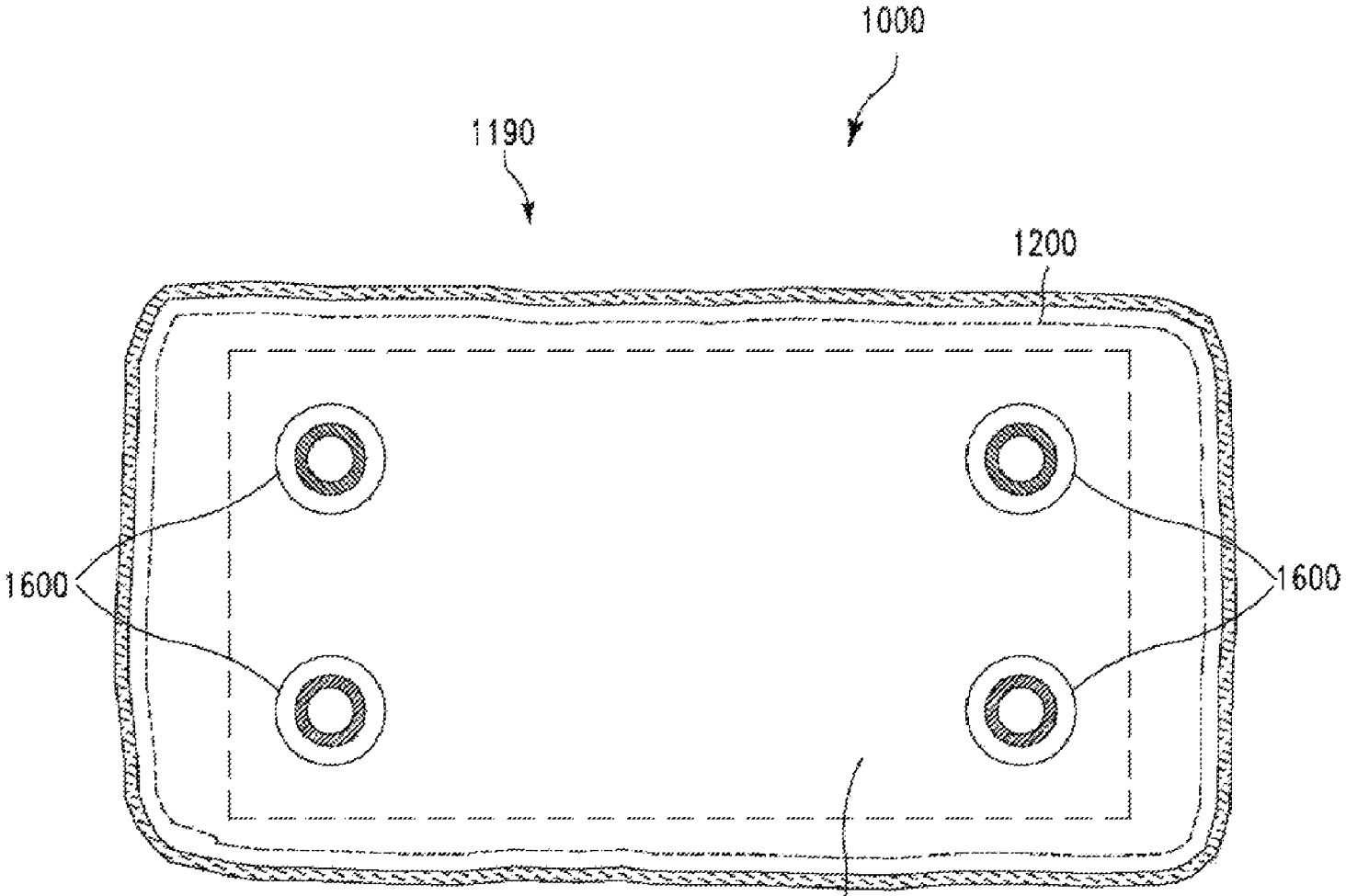
FIG. 4 is a plan view from below the improved flexible storage container of FIG. 1.

FIG. 4 is a plan view from below the improved storage container of FIG. 1.

Here the bottom 1190 with a bottom support 1195 can be seen. The bottom support 1195 can be made as a flat plate which lies onto the bottom of storage container 1000.

Also, optionally, to keep the storage container 1000 away from moisture, it may include feet 1600 which lift the container of the floor preventing it from absorbing water through its bottom.

Alternative Embodiments

Even though the example shown and described above was for storage of a handbag, it applies equally for other items intended to be stored. The storage container 1000 may also be sized and shaped to store shoes. As described above, leather is required to be stored in specific conditions. Other hard to store items are furs, silk items and suede. These also require proper storage conditions.

In still another embodiment of the present invention as shown in phantom in FIG. 1, a plurality of attachments 1910 are attached to the top of storage container 1000. Hanging devices 1930 are connected to attachments 1910 and to the item being stored. These hold the item in an upright position so that it does not fold over creating creases and trapping moisture.

In still another embodiment of the present invention as shown in FIG. 1 in phantom, a set of rigid upright supports 1940 may be included. Items, such as handbags or shoes fit down over the supports to hold them in an upright, non-folded position. A handbag, for example may be inserted upside down in an open position over the upright supports.

Figure 5:
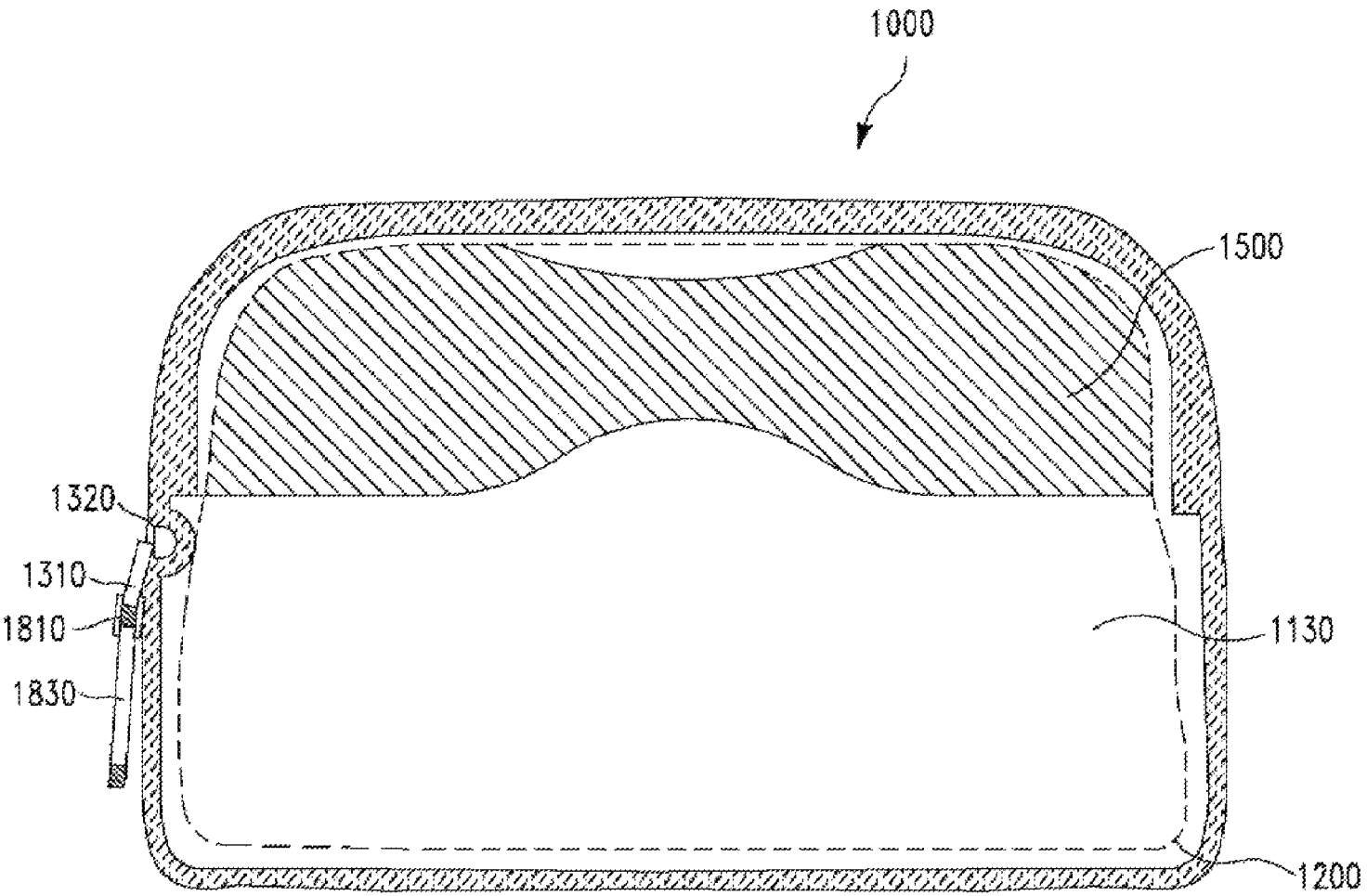
FIG. 5 is an elevation view of the outside surface of another embodiment of the improved flexible storage container according to the present invention.

FIG. 5 is an elevation view of the outside surface of another embodiment of the improved flexible storage container according to the present invention.

In FIG. 5 the hypoallergenic barrier 1200 is shown in phantom encircling the inside of storage container 1000. In order to allow easier access to the storage container 1000, a handle 1500 is attached to rear wall 1130. ID tag 1810 and tag clip 1830 are visible here.

Figure 6:
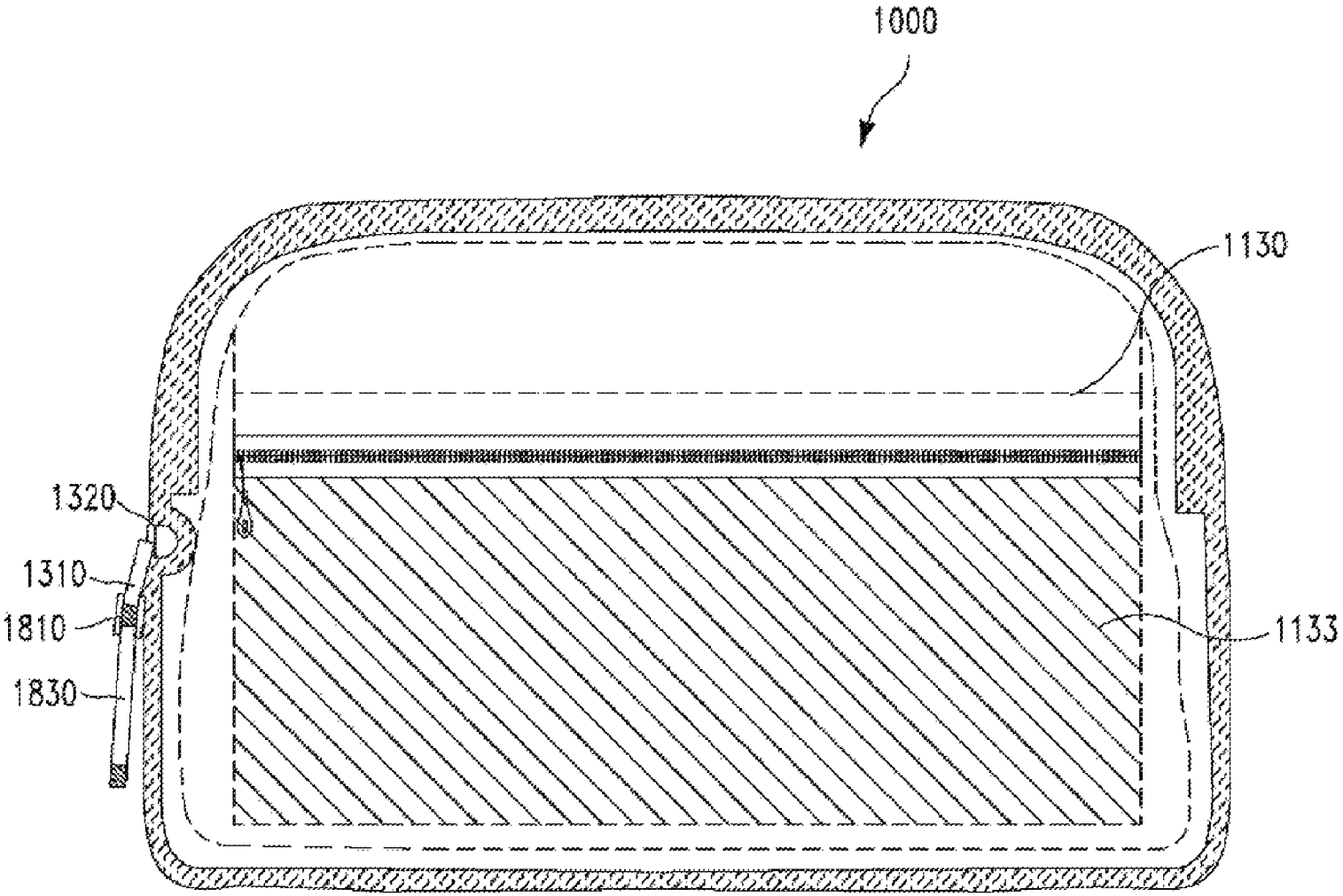
FIG. 6 is a cross sectional view just inside of the back surface of another embodiment of the improved flexible storage container according to the present invention.

FIG. 6 is a cross sectional view just inside of the rear wall 1130 of another embodiment of the improved flexible storage container according to the present invention. Here, an interior pocket 1133 is employed to hold additional items.

Figure 7:
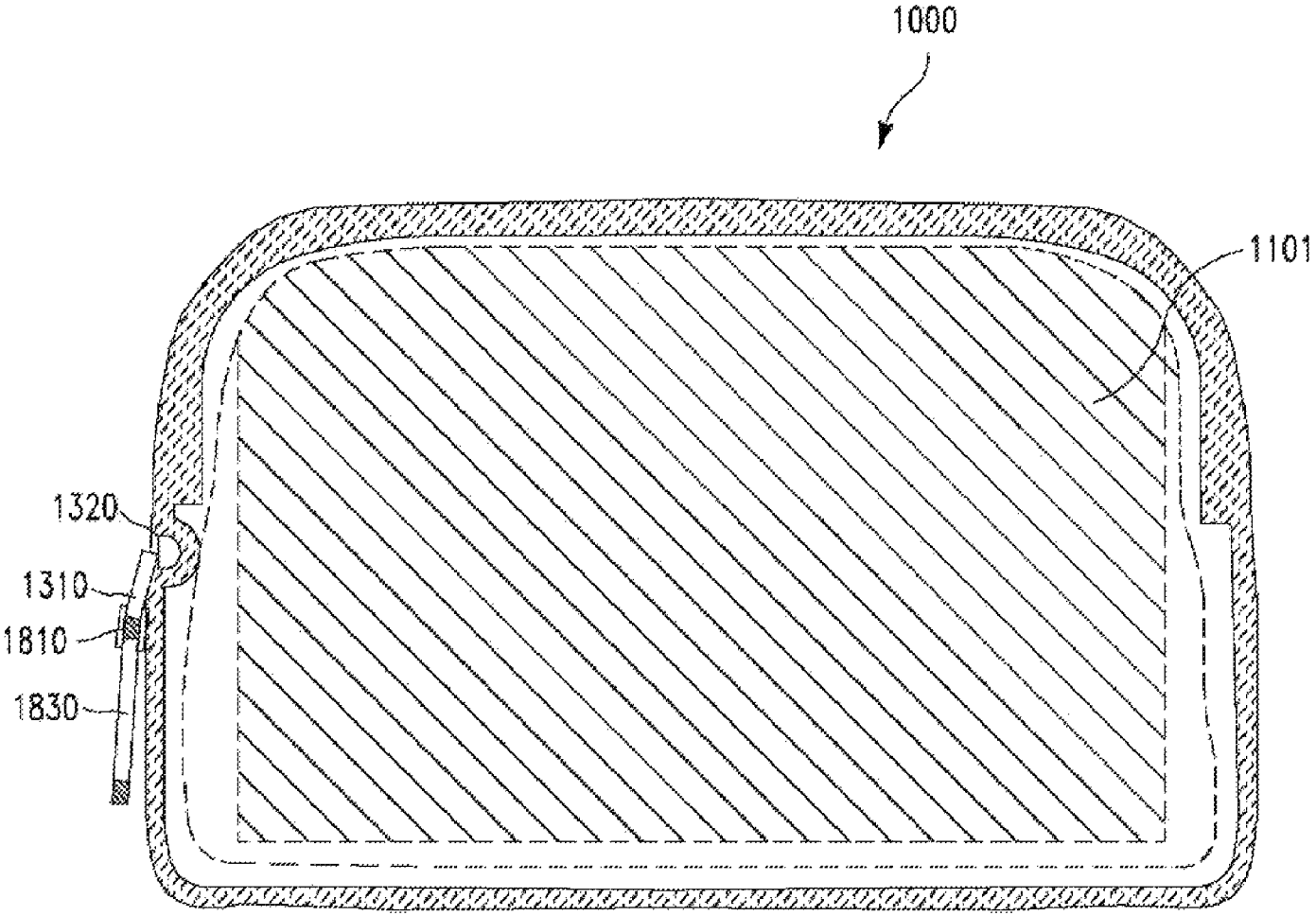
FIG. 7 is a cross sectional view of another embodiment of the improved flexible storage container according to the present invention.

FIG. 7 is a cross sectional view of another embodiment of the improved flexible storage container 1000 according to the present invention.

FIG. 7 shows an optional internal divider panel 1101 which divides the storage container into a front and back section.

It is of course understood that departures can be made from the preferred embodiments of the present invention by those of ordinary skill in the art without departing from the spirit and scope of the invention.

What is claimed is:

1. A handbag storage device for mitigating the collection of dust and dust mites on an outermost handbag wall surface of a handbag while the handbag is being stored, the handbag storage device comprising:

a flexible outer shell made of a breathable material that allows passage of moisture through the flexible outer shell in either direction, the flexible outer shell sized and shaped to contain the handbag such that the outermost handbag wall surface forming the exterior of the handbag is wholly contained within the flexible outer shell;

a flexible breathable hypoallergenic barrier lining the flexible outer shell at a location either inside or outside the flexible outer shell, the hypoallergenic barrier constructed of a material having pores of less than 10 microns for preventing dust from passing through the hypoallergenic barrier while allowing moisture to travel through the material, the hypoallergenic barrier sized and shaped to contain the handbag such that the outermost handbag wall surface forming the exterior of the handbag is wholly contained within hypoallergenic barrier; and a closure device on either the flexible outer shell or the hypoallergenic barrier for closing the handbag within the handbag storage device.

2. The handbag storage device of claim 1, the closure device has no openings greater than 10 microns when closed.

3. The handbag storage device of claim 1 wherein the handbag storage device is sized to approximate two womans' handbags in a standing position and a divider panel is positioned between the two womans' handbags.

4. The handbag storage device of claim 1 wherein the hypoallergenic barrier is constructed of a tight weave cotton/polyester blend.

5. The handbag storage device of claim 1 further comprising:

at least one hanging device to attach to the handbag being stored and hold it in an upright position preventing folding.

6. The handbag storage device of claim 1 further comprising:

at least upright support to hold the handbag being stored in an upright position preventing folding.

7. The handbag storage device of claim 1 wherein the closure device is specially designed to have a mechanical portion which has no gaps greater than 10 micrometers and any fabric which the closure device employs also has a weave which has no pores greater than 10 micrometers.

8. The handbag storage device of claim 1 further comprising:

an image of the handbag contained, or the handbag intended to be contained, within the handbag storage device, the image affixable or affixed to the handbag storage device for identifying the handbag contained within the handbag storage device, while the handbag is being stored.

9. The handbag storage device of claim 1, the flexible outer shell having a color for associating and identifying the handbag contained within the handbag storage device, while the handbag is being stored.

* * * * *